US006079580A

United States Patent [19]

Garton et al.

[11] Patent Number: 6,079,580

[45] Date of Patent: Jun. 27, 2000

[54] MOLDED TANK

[75] Inventors: Darwin D. Garton, Malcom; H. Todd Bolzer, Lincoln, both of Nebr.

[73] Assignee: Snyder Industries, Inc., Lincoln, Nebr.

[21] Appl. No.: 09/060,483

[22] Filed: Apr. 15, 1998

[51] Int. Cl.[7] ..... B65D 1/42; B65D 21/00; B65D 88/00

[52] U.S. Cl. ..... 220/1.5; 206/509; 220/647; 220/675

[58] Field of Search ..... 220/1.5, 606, 646, 220/647, 675, 4.12, 668; 206/503, 509, 511

[56] References Cited

U.S. PATENT DOCUMENTS

| | | | |
|---|---|---|---|
| 3,446,394 | 5/1969 | Miller et al. | 206/511 |
| 3,650,501 | 3/1972 | Streb | 248/146 |
| 3,912,103 | 10/1975 | Gerhard | 220/562 X |
| 4,356,925 | 11/1982 | Gerhard | 220/647 X |
| 4,445,624 | 5/1984 | Gill | 220/668 X |
| 4,840,282 | 6/1989 | Gerhard | 220/1.5 |
| 4,899,901 | 2/1990 | Nickel | 220/647 |
| 4,989,741 | 2/1991 | Dull et al. | 220/1.5 |
| 5,544,777 | 8/1996 | Watson | 220/1.5 X |
| 5,688,086 | 11/1997 | Menzemer et al. | 410/68 |

FOREIGN PATENT DOCUMENTS 2082881 10/1971 France .

*Primary Examiner*—Allan N. Shoap
*Assistant Examiner*—Joe Merek
*Attorney, Agent, or Firm*—Hovey, Williams, Timmons & Collins

[57] ABSTRACT

A preferred container apparatus (10) includes tank walls integrally molded of synthetic resin material making up a tank assembly (12) defining a storage chamber (38). The tank walls are configured as a cylindrical tank section 20) and as a plurality of six stacking legs (22–32) wherein the tank section (20) and legs (22–32) both define contiguous portions of the storage chamber (38). The stacking legs (22–32) extend between the top (50) and bottom (52) of the tank section (20) on both sides thereof, and present flat end walls (64, 66, 78) allowing one tank assembly (12) to be stacked on another. The preferred apparatus (10) also includes a base (18) for receiving and supporting a tank assembly (12) wherein the base (18) includes openings or slots (136–142) for receiving forklift tines to lift the apparatus (10) using a forklift.

6 Claims, 3 Drawing Sheets

10
12
14
16
18
20
22
24
26
28
30
32
34
36
42
44
46
48
54
58
60
64
66
68
70
78
80
84
86
88
D
122
124
126
128
130
132
134
136
138
140
142

MOLDED TANK

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention deals with the field of tanks for storage or transport molded of synthetic resin material. More particularly, the invention is concerned with a preferred container apparatus including tank walls integrally molded of synthetic resin material making up a tank assembly defining a chamber. The tank walls are configured as a cylindrical tank section and as a plurality of six stacking legs wherein the tank section and legs both define contiguous portions of the chamber.

2. Description of the Prior Art

Certain types of tanks for storage or transport can be economically manufactured by molding synthetic resin material such as high density polyethylene. Synthetic resin has the advantage of being non-rusting and resistant to corrosion when storing and transporting some chemicals.

However, synthetic resin tanks are typically not as strong as metal tanks of the same size. Moreover, most tanks are cylindrical in shape which prevents stacking.

SUMMARY OF THE INVENTION

The present invention solves the prior art problems mentioned above and provides a distinct advance in the state of the art. In particular, the container apparatus hereof is particularly strong and is configured to allow stacking.

The preferred container apparatus includes a tank assembly, a lifting assembly and a base. The tank assembly is integrally molded of synthetic resin material to define a storage chamber, and includes tank walls configured as a tank section defining a portion of the chamber and a plurality of stacking legs, the walls of which also define a portion of the chamber. The upper and lower ends of the stacking legs present flat surfaces allowing one tank assembly to be stacked on another.

The preferred lifting assembly includes a pair of pipes extending along opposed sides of the tank section and through the stacking legs adjacent the upper ends thereof. A lifting eye is attached to each pipe allowing the tank assembly to be lifted and positioned as desired using a crane or hoist.

The preferred base is also composed of synthetic resin material and is configured to receive and support a tank assembly. The base includes openings configured and spaced to receive the tines of a forklift for lifting and positioning the apparatus. Other preferred aspects of the present invention are disclosed herein.

DETAILED DESCRIPTION OF THE PREFERRED EMBODIMENT

Figures 1, 3, 4, 5, 6, 7:
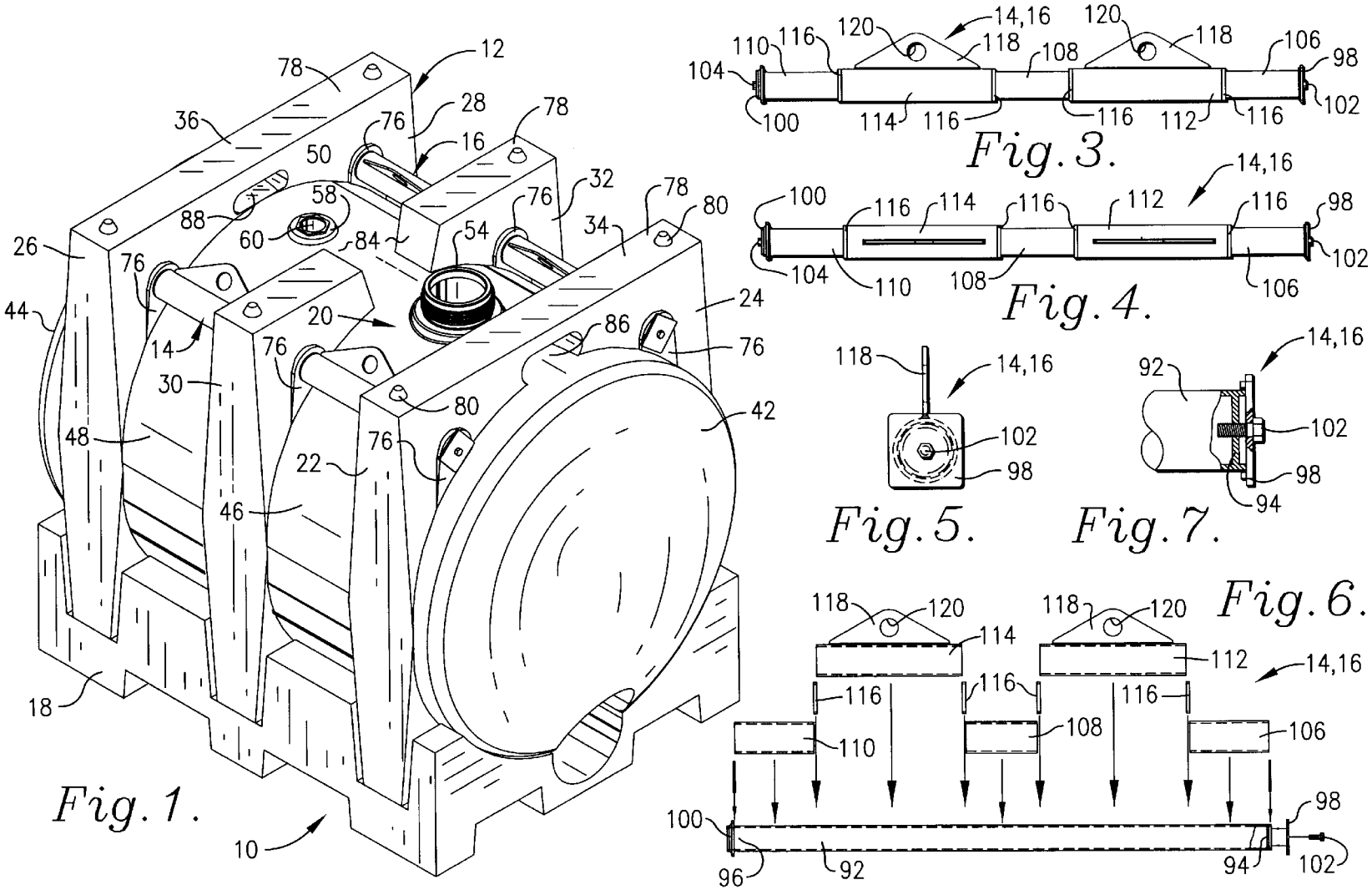
FIG. 1 is a top, right, front pictorial view of the preferred container apparatus in accordance with the present invention.
FIG. 3 is a side elevational view of the preferred lifting assembly of FIG. 1.
FIG. 4 is a top plan view of the lifting assembly of FIG. 3.
FIG. 5 is an end elevational view of the lifting assembly of FIG. 3.
FIG. 6 is an exploded view of the lifting assembly of FIG. 3.
FIG. 7 is a partial side elevational view of the lifting assembly of FIG. 3 shown in partial section.

The drawing figures illustrate preferred tank apparatus 10 in accordance with the present invention. Apparatus 10 includes tank assembly 12, lifting assemblies 14 and 16 and base 18.

Tank assembly 12 is made up of a plurality of tank walls integrally molded of synthetic resin material with a thickness of about 0.5". The preferred synthetic resin is rotational molding grade, linear low density polyethylene selected because of the strength of this material. It will be appreciated that other materials can be used as long as they can be molded and provide sufficient strength for holding flowable materials—liquids and granulated solids.

The tank walls of tank assembly 12 include tank section walls configured as tank section 20 and leg section walls configured as front stacking legs 22 and 24, rear stacking legs 26 and 28, middle stacking legs 30 and 32, and front and rear cross legs 34 and 36. Additionally, the walls of tank assembly 12 define storage chamber 38.

Tank section 20 presents a generally cylindrical configuration, oriented horizontally, and defines tank chamber portion 40 of storage chamber 38. Tank section 20 further includes dished front wall 42, dished rear wall 44 and intermediate tanks walls 46 and 48.

As best viewed in FIG. 1, intermediate tank wall 46 is positioned generally between front stacking legs 22, 24 and middle stacking legs 30, 32. Similarly, intermediate tank walls 48 are positioned generally between rear stacking legs 26, 28 and middle stacking legs 30, 32. Also, front wall 42 is positioned adjacent the outboard side of front legs 22, 24, and rear wall 44 is positioned adjacent the outboard side of rear legs 26, 28. Tank section 20 also presents top 50 and bottom 52.

Figure 9:
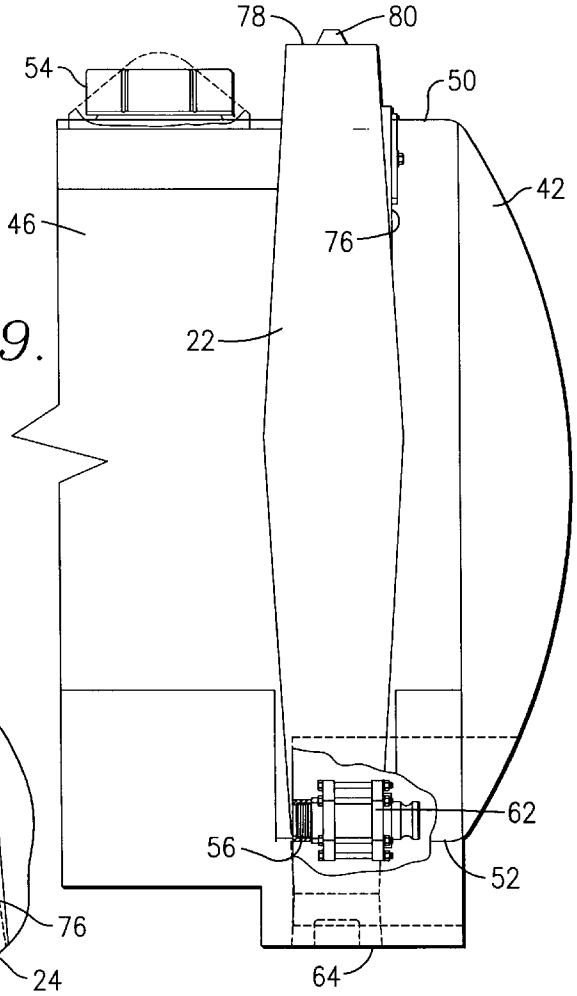
FIG. 9 is a side elevational view of the tank assembly portion of FIG. 8 with portions cut away for clarity of illustration and with portions thereof illustrated by hidden lines.
Figure 8:
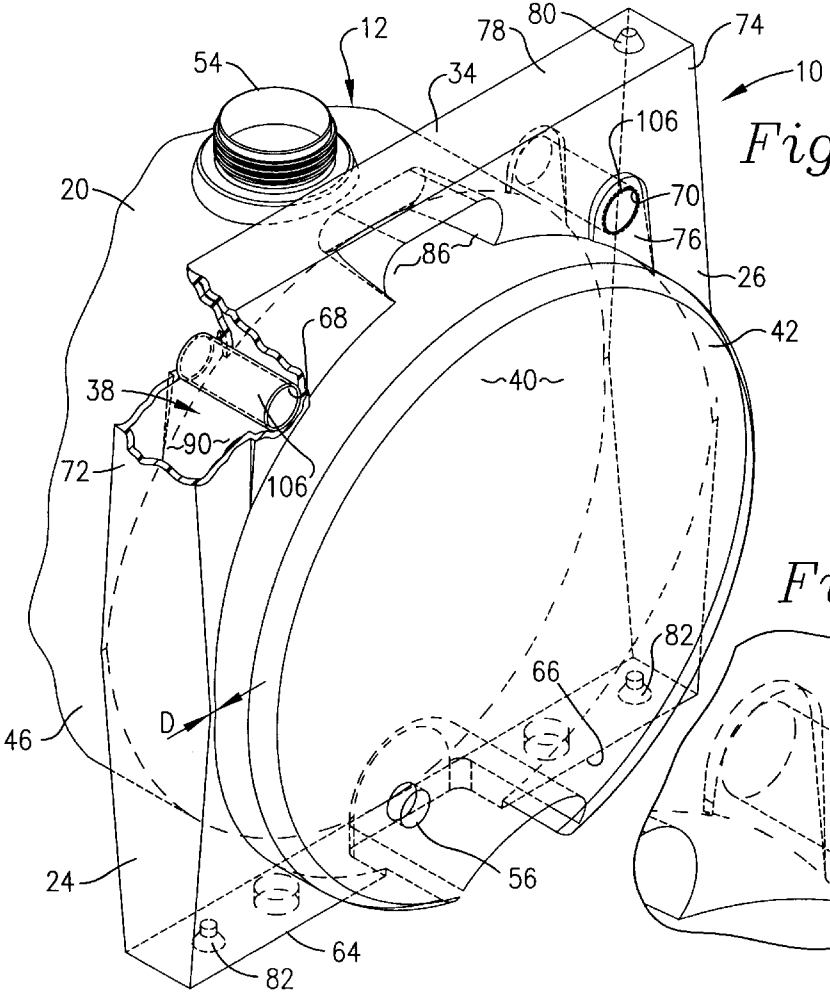
FIG. 8 is a partial, top, right, front pictorial view of the tank assembly of FIG. 1 with portions thereof illustrated by hidden lines and with portions cut away for clarity of illustration.

Referring to FIGS. 1, 8 and 9, tank section 20 further includes threaded, integrally molded, inlet pipe 54, threaded, integrally molded, outlet pipe 56 and integrally threaded bung 58, all molded into the walls of section 20 during manufacture. Referring to FIGS. 8 and 9, pipe fitting 62 is received on outlet pipe 56 with the bottom walls of tank section 20 being formed into an archway in the vicinity of outlet pipe 56 for convenient access from the front of apparatus 10.

Front stacking legs 22 are positioned adjacent front wall 42 on opposed sides of tank section 20 and extend in elevation between bottom 52 to a position above top 50. As best viewed in FIG. 8, the lower portions of front stacking legs 22, 24 curve inwardly and present planar lower ends or faces 64 and 66. Faces 64, 66 are in the same plane as bottom 52 which is the lowermost elevation of tank section 20. In this way, faces 64, 66 define a contiguous flat area for supporting tank assembly 12.

Figure 10:
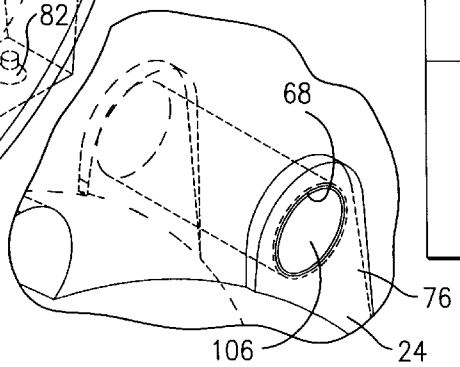
FIG. 10 is a close-up view of a tank sleeve portion of the tank assembly of FIG. 8.

Referring to FIGS. 8 and 10, it will be noted that front legs 22, 24 include respective lifting pipe holes 68 and 70 defined therethrough adjacent respective upper ends 72 and 74 thereof. Holes 68 and 70 are configured for receiving the lifting pipes of lifting assemblies 14, 16 as explained further herein. Legs 22 and 24 also include flat areas 76 adjacent the openings of each of pipe holes 68, 70 for use in securing lifting assemblies 14, 16, also as explained further herein. Flat areas 76 also provide for reinforcement of holes 68, 70 for added strength during lifting. The offset between the upper edge of flat areas 76 and the adjacent leg surface is between about 0.15 and 1.15" and preferably about 0.65" in the preferred embodiment as the optimum dimension for reinforcing strength. This range is critical because if too wide, the structure becomes too flexible and if too narrow, provides insufficient support. This optimum distance will be different for tanks of different sizes.

Front cross leg 34 is contiguous with front stacking legs 22, 24 and extends therebetween over top 50 of tank section 20. Cross leg 34 and upper ends 72, 74 present planar, upper stacking surface 78 with lugs 80 extending upwardly therefrom adjacent the respective ends of cross leg 34. Lugs 80 are configured for reception in corresponding lug ports 82 defined in the lower faces 64, 66 of another tank assembly 12 when stacking. That is, lower faces 64, 66 are configured for mating engagement with the upper stacking surface 78 of another tank assembly 18. In the stacking relationship, with one assembly atop the other, lugs 80 are received in registration with the corresponding lug ports 82. This aligns the tank assemblies and also prevents shifting of the contact surfaces. It will be appreciated that these lugs 80 are not required on every leg or joint as long as sufficient lugs 80 are provided to prevent side movement between stack tanks.

Rear stacking legs 26, 28 are positioned adjacent rear wall 44 of tank section 20 and are otherwise configured the same as front stacking legs 22, 24. Similarly, rear cross leg 36 extends between rear stacking legs 26 in the same way as front cross leg 34 extends between front stacking legs 22, 24.

Middle stacking legs 30, 32 are also configured the same as front stacking legs 22, 24. It will be noted, however, that there is no cross leg positioned between middle legs 30, 32. Thus, there is a gap 84 across the top of tank section 20 between middle legs 30, 32. Similarly, there is a relieved area 86 in front cross leg 34 adjacent the top of tank section 20 and another relieved area 88 in rear cross leg 36. Gap 84 and relieved areas 86, 88 cooperate to prevent hinged motion of tank assembly 12 during filling and emptying, and to prevent distortion when the tank is under pressure or vacuum.

As will now be appreciated, stacking legs 22–32 are configured for secure stacking of one tank assembly 12 on another. Specifically, lower faces 64 and 66 of stacking legs 22–32 are configured for engaging the upper stacking surfaces 78 of the stacking legs of another tank assembly 12. Such places one tank assembly 12 atop another in a stacking relationship with lower surfaces 64, 66 of the upper tank assembly 12 matingly engaging the upper stacking surfaces 78 of the lower tank assembly 12.

Legs 22–36 also define a portion of storage chamber 38. That is, the walls of legs 22–32 define leg chamber portion 90 contiguous with tank chamber portion 40. Accordingly, tank chamber portion 40 and leg chamber portion 90 cooperate to form storage chamber 38. In this way, tank assembly 12 gains the structural and stacking advantages provided by legs 22–32 without sacrificing storage capacity.

Moreover, it will be appreciated by those skilled in the art that stacking legs 22–32 along with cross legs 34, 36 are configured to add structural reinforcement to tank assembly 12. Accordingly, tank assembly 12 presents structure enabling storage chamber 38 to be hydrostatically pressurized to at least 100 kilopascals for at least ten minutes without leaking. Furthermore, tank assembly 12 is strong enough to be dropped without breaking from a height of between about 3 feet and 7 feet after being conditioned to about 0° F. As best viewed in FIGS. 2 and 8 for example, each leg 22–32 is configured so that the outboard face is spaced from the cylindrical wall of tank section 20. At the narrowest point, this spacing presents dimension D which is between about 0.25 and 0.75 inches and preferably about 0.50 inches. This range is preferred as an aid to the structural integrity of tank assembly 12.

FIG. 1 illustrates lifting assemblies 14, 16 in position for enabling a hoist or a crane to lift tank assembly 12. As illustrated in FIGS. 2–7, each lifting assembly includes a lifting bar in the nature of pipe 92, insert plates 94 and 96, end caps 98 and 100, mounting bolts 102 and 104, tank sleeves 106, 108 and 110, lifting sleeves 112 and 114, and four spacer collars 116.

Pipe 92 is preferably 2½", schedule 40 pipe long enough to extend through lifting pipe holes 68–70 of stacking legs 22–28 as illustrated in FIG. 1. More particularly, each end of pipe 92 is flush with the flat area 76 of the outboard wall of respective front and rear stacking legs.

Insert plates 94, 96 are received and recessed about ¼" in the opposed ends respectively of pipe 92 and welded in place. Each plate 94, 96 includes a central threaded opening for receiving a respective mounting bolt 102.

Square end caps 98, 100 are positioned against the opposed ends of pipe 92. Mounting bolts 102, 104 extend from the outboard sides of end caps 98, 100, through respective central bolt holes in caps 98, 100 and threadably coupled with insert plates 94, 96 as best viewed in FIGS. 5 and 7. With bolts 102, 104 drawn tight, the inboard faces of end caps 98, 100 engage the flat areas 76 defined in the outboard surfaces of front stacking legs 22, 24 and rear stacking faces 26, 28. This holds each pipe 92 of each lifting assembly 14, 16 in position and also longitudinally reinforces the structural strength of tank assembly 12.

As best viewed in FIGS. 8 and 10, the three tank sleeves 106, 108 and 110 are positioned in the respective lifting pipe holes 68, 69 and 70 of stacking legs 22–32. Sleeves 106–110 structurally reinforce holes 68–70.

Lifting sleeve 112 is positioned over pipe 92 between tank sleeves 106 and 108 and thereby between a respective front stacking leg 22, 24 and middle stacking leg 30, 32. Similarly, lifting sleeve 114 is positioned over pipe 92 between tank sleeves 108 and 110 and thereby between a respective middle stacking leg 30, 32 and rear stacking leg 26, 28. It will be appreciated that lifting pipe holes 68–70 can be formed without sleeves and can present shapes other than the preferred circular hole.

A spacer collar 116 is positioned around pipe 92 at each end of lifting sleeves 112, 114. Each spacer collar 116 acts as a washer and engages the flat area 76 of the adjacent stacking leg 22–32.

Each lifting sleeve 112 further includes outwardly extending gusset 118 welded thereto with an opening defined therein as lifting eye 120 for receiving a lifting hook or cable from a crane or hoist, for example. As best viewed in FIG. 1, it will be noted that lifting assemblies 14, 16 are rotated so that gussets 118 are angled inwardly. This is preferred so that gussets 118 are aligned with any lifting cables to resist rotation of assemblies 12, 14 during a lift.

Figure 2:
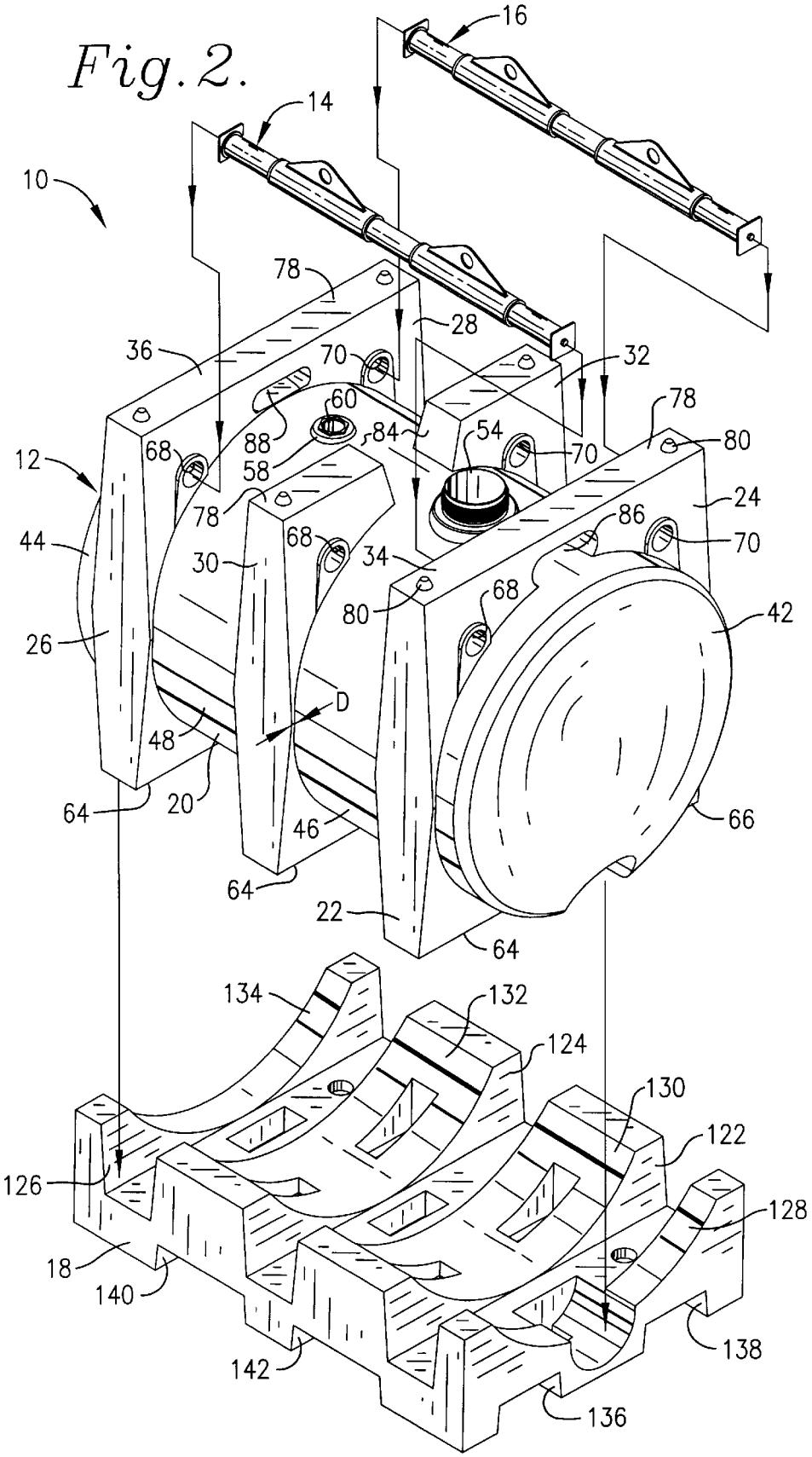
FIG. 2 is an exploded view of the apparatus of FIG. 1.

FIGS. 1 and 2 illustrate base 18 in general, base 18 is configured to receive and support tank assembly 12 thereon. In particular, base 18 includes three spaced transverse slots 122, 124 and 126 having flat bottom walls configured for mating engagement with lower faces 64, 66 of stacking legs 22–32 in order to support these legs and thereby support tank assembly 12.

Additionally, base 18 is configured to define curved walls 128, 130, 132 and 134 shaped for mating engagement with the curve tank walls of tank section 20. Specifically, curved walls 128 and 134 are shaped for mating engagement with the bottom wall of tank section 20 respectively adjacent front and rear walls 42, 44; and curved walls 130, 132 are shaped for mating engagement with the two bottom walls of tank section 20 between stacking legs 22–32.

Base 18 is also configured to present four forklift slots 136, 138, 140 and 142. Slots 136 and 138 extend along the length of base 18 adjacent the lower surface thereof and are open at both ends. Slots 136, 138 are spaced and positioned for receiving the tines or forks of a conventional forklift truck. In this way, base 18 and tank assembly 12 supported thereby can be lifted and moved without the need for a crane or hoist. Similarly, forklift slots 140 and 142 are positioned transverse to slots 136, 138 between the side walls of base 18. These slots allow a forklift to lift apparatus 10 when approaching from either side. It is preferred that base 18 be molded from the same synthetic resin material as tank assembly 12, although there are a wide variety of other acceptable synthetic resins presenting sufficient strength for supporting tank assembly 12.

The lower surfaces of base 18 are planar for resting on a flat support surface such as a floor or deck and are also configured for mating engagement with upper stacking surfaces 78 of another apparatus 10. That is, one apparatus can be stacked on another with the base of the upper apparatus resting on the stacking surfaces 78 of the lower apparatus. This is a particular advantage because a forklift can be used for the stacking process and also for unstacking as needed to change the location of apparatus 10.

On the other hand, if an installation is contemplated as permanent, the use of base 18 can be omitted. For example, using a crane or hoist to engage lifting assemblies 14, 16 a first tank assembly can be placed directly on the floor or deck without the use of a base and a second tank assembly stacked on top of the first.

Having thus described the preferred embodiment of the present invention, the following is claimed as new and desired to be secured by letters patent:

What is claimed is:

1. A container apparatus comprising:

a plurality of tank walls making up a tank assembly integrally molded of synthetic resin material and defining a storage chamber for storing flowable material, said tank walls including:

tank section walls configured as a tank section defining a tank chamber portion of said storage chamber, said tank section presenting a top and a bottom; and leg section walls defining a leg chamber portion of said storage chamber contiguous with said tank chamber portion, and configured as a plurality of upright stacking legs positioned respectively on opposed sides of said tank section and extending between said top and bottom, said stacking legs each including upper and lower leg ends with at least one of said leg ends configured for matingly engaging a leg end of another of said apparatus in a stacking relationship therewith, one atop the other, said tank section presenting opposed ends, said leg section walls being configured as two pairs of said stacking legs respectively adjacent said opposed ends, said stacking legs presenting upper ends, said apparatus further including a pair of lifting bars extending between and through said upper leg ends of said stacking legs on opposed sides of said tank section for lifting said apparatus, said lifting bars presenting respective lifting bar ends secured to said stacking legs and further including respective lifting sleeves received around said lifting bars between the upper ends of said stacking legs.

2. The apparatus as set forth in claim 1, said lifting bars presenting a tubular configuration.

3. The apparatus as set forth in claim 2, said lifting bars being composed of metal pipe.

4. A container apparatus comprising:

a plurality of tank walls making up a tank assembly integrally molded of synthetic resin material and defining a storage chamber for storing flowable material, said tank walls including:

tank section walls configured as a tank section defining a tank chamber portion of said storage chamber, said tank section presenting a top and a bottom;

leg section walls defining a leg chamber portion of said storage chamber continuous with said tank chamber portion, and configured as a plurality of upright stacking legs positioned respectively on opposed sides of said tank section and extending between said top and bottom, said stacking legs each including upper and lower leg ends with at least one of said leg ends configured for matingly engaging a leg end of another of said apparatus in a stacking relationship therewith, one atop the other; and a cross leg joining the upper leg ends of opposed ones of said stacking legs and having an opening beneath the cross leg and between the upper leg ends of said opposed ones of said stacking legs to present a relieved area intermediate thereof and adjacent said tank section.

5. A container apparatus comprising:

a plurality of tank walls making up a tank assembly integrally molded of synthetic resin material and defining a storage chamber for storing flowable material, said tank walls including:

tank section walls configured as a tank section defining a tank chamber portion of said storage chamber, said tank section presenting a top and a bottom;

leg section walls defining a leg chamber portion of said storage chamber contiguous with said tank chamber portion, and configured as a plurality of upright stacking legs positioned respectively on opposed sides of said tank section and extending between said top and bottom, said stacking legs each including upper and lower leg ends with at least one of said leg ends configured for matingly engaging a leg end of another of said apparatus in a stacking relationship therewith, one atop the other, said stacking legs further including first and second pairs of stacking legs respectively adjacent opposed ends of said tank section and a third pair of stacking legs whose upper leg ends are intermediate, longitudinally spaced and separate from said first and second pairs of stacking legs.

6. A container apparatus as set forth in claim 5, wherein the upper ends of said third pair of stacking legs are transversely spaced to present a gap therebetween.

* * * * *